United States Patent [19]

Green

[11] Patent Number: 5,015,335

[45] Date of Patent: May 14, 1991

[54] CHLORINE DIOXIDE STATIC DISTRIBUTOR

[75] Inventor: Charles E. Green, Westchester, Ohio

[73] Assignee: Champion International Corporation, Stamford, Conn.

[21] Appl. No.: 586,529

[22] Filed: Sep. 17, 1990

[51] Int. Cl.[5] ..... D21C 7/06; D21C 9/14

[52] U.S. Cl. ..... 162/243; 261/123; 366/336

[58] Field of Search ..... 162/57, 243, 246, 67, 162/66; 261/123; 366/336, 337, 340

[56] References Cited

U.S. PATENT DOCUMENTS

| | | | |
|---|---|---|---|
| 472,421 | 4/1892 | Young | 162/243 |
| 2,576,733 | 11/1951 | Vasold | 366/337 |
| 2,764,011 | 9/1956 | Richter | 162/243 |
| 4,421,696 | 12/1983 | Graue | 261/123 |

*Primary Examiner*—Steve Alvo

*Attorney, Agent, or Firm*—Evelyn M. Sommer

[57] ABSTRACT

A static distributor is provided with a top surface that slopes upwardly from the center port opening through which chlorine dioxide and pulp stock are pumped into a bleaching tower. The upwardly sloping sides of the distributor provide a dish-shaped or concave configuration influencing the flow from the center port opening upwardly and outwardly toward the circumference of the tower. The static distributor is provided with side openings formed by vertical support plates. The vertical support plates are spaced about the circumferences of the concave or dish-shaped flow surface to support the same on a base and change the flow distribution so that a good portion of the flow is radial between the plates rather than vertical. The radial flow is mixed with the flow undergoing upward influence provided by the dish-shaped center portion of the distributor, which causes more complete mixing and the formation of a vortex-type flow in the bleaching tower. Together with the improved mixing, improved economics in energy and/or power costs are realized.

3 Claims, 2 Drawing Sheets

CHLORINE DIOXIDE STATIC DISTRIBUTOR

BACKGROUND OF THE INVENTION

1. Field of the Invention

This invention relates to a chlorine dioxide distributor, and more particularly, to a distributor used to mix chlorine dioxide into solution in a bleach tower used as part of a wood pulp bleaching system in a paper making process.

2. Description of the Prior Art

Chlorine dioxide is used in conventional oxidation systems as part of a wood pulp bleaching system in a paper making process.

In one example of such a process, unbleached pulp from a digester is supplied to brown stock washers where it is washed. The washed, unbleached pulp from the washers is conducted to a first stage bleach tower and then passed in sequence through a washer, a first stage caustic extraction tower, a washer, a second stage bleach tower, a washer, a second stage caustic extraction tower, a washer, a third stage bleach tower, and a final washer, supplying bleached, color-lightened, pulp to a paper forming machine.

In the bleach tower, chlorine dioxide or chloride dioxide and chlorine is supplied through a line into an oxidation vessel or tower and color reduction of the pulp stock allowed to take place. Chlorine dioxide or chlorine dioxide in admixture with chlorine, usually in a gaseous state, and pulp stock are pumped into the bleaching tower through a static distributor wherein the bleaching of the cellulosic pulp takes place. One typical static distributor contains a central opening in a dome-shaped surface wherein the pumped chlorine dioxide and pulp stock are allowed to cascade over the sides. The dome is provided with side openings so that radial flowing chlorine dioxide and pulp stock can mix with the cascading chlorine dioxide and pulp stock to ensure more thorough mixing. Another typical static distributor is umbrella shaped but is not provided with a central opening. The mixing takes place but in this instance with the pumped chlorine dioxide and pulp stock impinging on the inner aspect of the umbrella surface and from there cascading downwardly to mix with the radially flowing chlorine dioxide and pulp stack.

The present invention relates to a static distributor providing a more improved flow and mixing than had been previously achieved and which realizes as well a marked energy efficiency.

SUMMARY OF THE INVENTION

A wood pulp produced by any of the known digestion processes is supplied to brown washers where the pulp is washed and then conducted in sequence to a high density storage tower and to a blend chest where the consistency of the pulp mixture is regulated to produce a pulp slurry. The pulp slurry is then pumped from the blend chest into a chemical mixer. A charge of chlorine dioxide (When the term chlorine dioxide is used hereafter, it is to be understood that a mixture of chlorine dioxide and chlorine is equally suitable.) or chlorine dioxide in admixture with chlorine is fed from a corresponding chlorine dioxide source or chlorine dioxide and chlorine sources into the chemical mixer. Subsequent to the addition of the chlorine dioxide, the pulp slurry-chlorine dioxide mixture is introduced into the bleaching tower through static distributor provided in the bottom of the tower. The chlorine dioxide as a gas can be passed into the aqueous dispersion of the pulp or the chlorine dioxide can be absorbed in aqueous solutions and added to the pulp in solution form. It is generally preferred to add the chlorine dioxide in solution form to the aqueous pulp slurry.

In accordance with the present invention, a static distributor is provided having a top surface that slopes upwardly from the center port opening through which the chlorine dioxide and pulp stock are pumped into the bleaching tower. The upwardly sloping sides of the distributor provide a dish-shaped or concave configuration influencing the flow from the center port opening toward the circumference of the upflow bleaching tower rather than providing a cascade effect as with a domed-shaped static distributor. The static distributor is provided with side openings between vertical support plates which are greatly enlarged in that side support plates are virtually eliminated. The vertical support plates of the concave or dish-shaped flow surface of the distributor changes the flow distribution so that a substantial portion of the flow is radial rather than vertical. The radial flow is mixed with the flow undergoing upward and outward influence provided by the dish-shaped center portion of the distributor, which causes a more complete mixing and the formation of a vortex-type flow in the bleaching tower.

BRIEF DESCRIPTION OF THE DRAWINGS

Further objects and advantages of the invention will become more apparent from the following description and claims and from the accompanying drawings, wherein:

DETAILED DESCRIPTION OF THE PREFERRED EMBODIMENT

Figure 1:
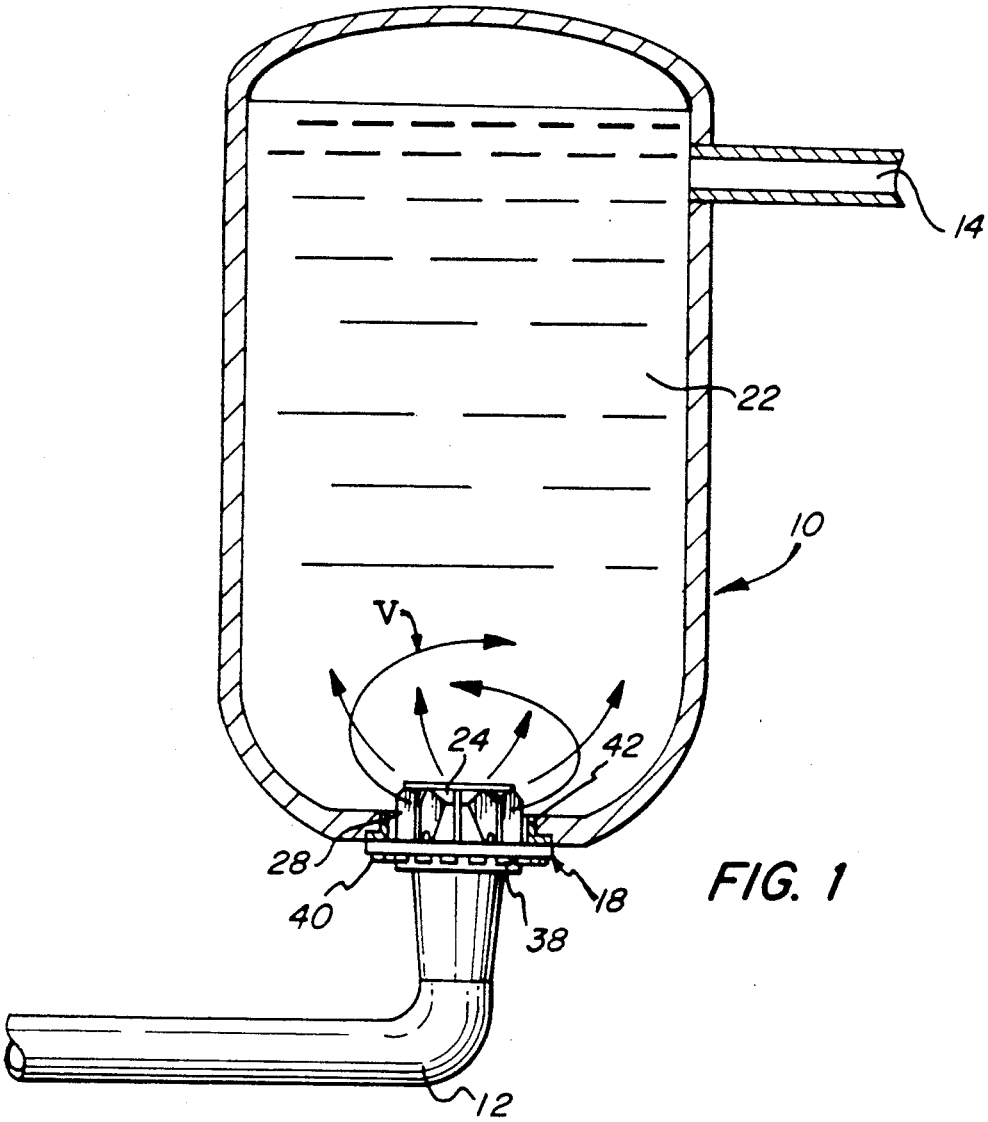
FIG. 1 is a cross-sectional view of a bleach tower of a wood pulp bleaching system provided with the chlorine dioxide static flow distributor of the present invention shown in side elevation.
Figure 2:
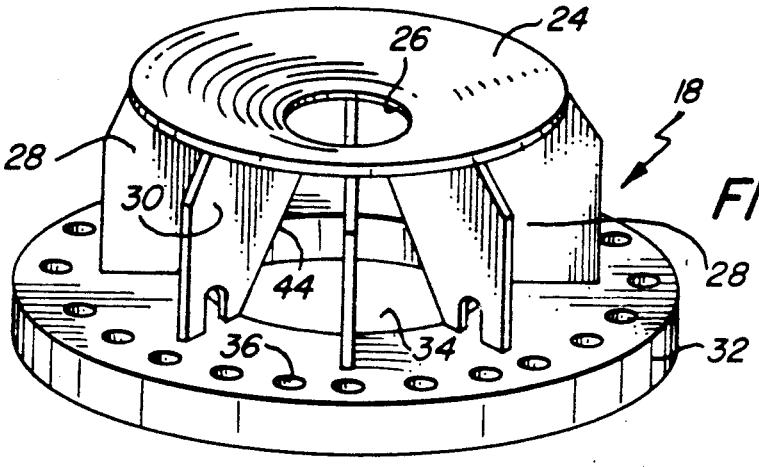
FIG. 2 is a perspective view of the chlorine dioxide static flow distributor illustrated in FIG. 1.
Figure 3:
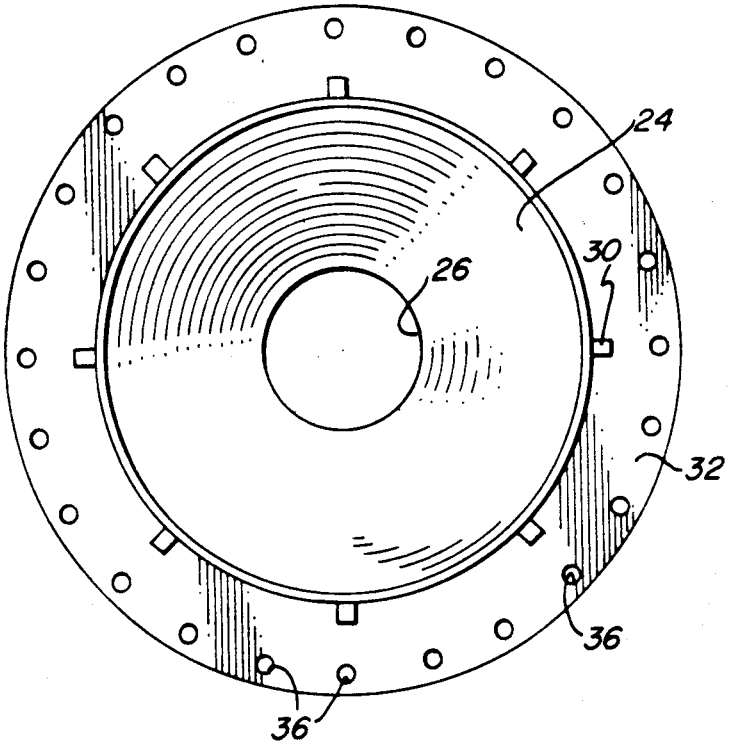
FIG. 3 is a top plan view of the chlorine dioxide static flow distributor of FIG. 2.
Figure 4:
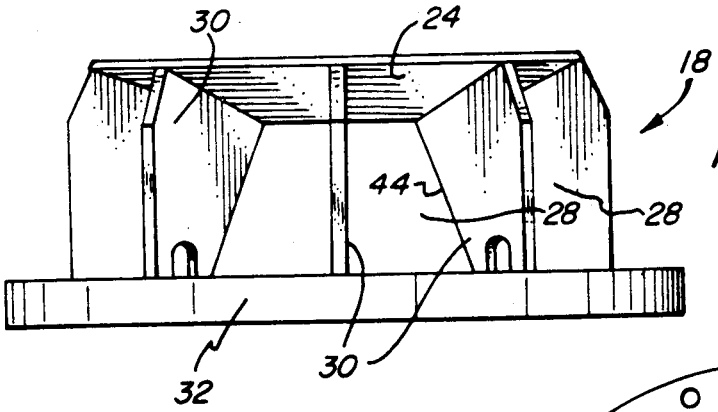
FIG. 4 is a side view in elevation of the chlorine dioxide static flow distributor of FIG. 2.
Figure 5:
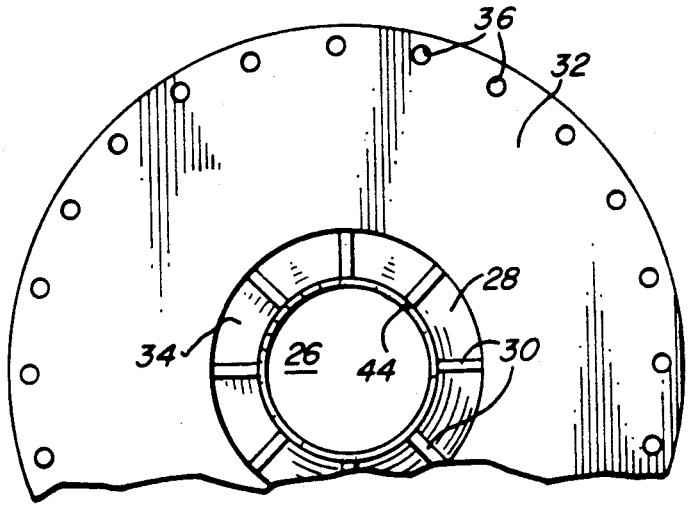
FIG. 5 is a partial bottom plan view of the chlorine dioxide static flow distributor of FIG. 2.

Referring now to the drawings in detail wherein like numerals indicate like elements throughout the several views. A wood pulp produced by any of the known digestion processes is supplied to brown washers (not shown) where the pulp is washed and then conducted in sequence to a high density storage tower (not shown) and to a blend chest (also not shown) where the consistency of the pulp mixture is regulated to produce a pulp slurry. The pulp slurry is then pumped from the blend chest into a chemical mixer (not shown). A charge of chlorine dioxide is fed from a chlorine dioxide source into the chemical mixer. Subsequent to addition of the chlorine dioxide the pulp slurry-chlorine dioxide mixture is introduced into pulp inlet 12 of a bleach tower 10 which is provided with a pulp inlet 12 and a pulp outlet 14. A static chlorine dioxide distributor 18 is seated in the bottom of tower 10. Digested washed pulp and chlorine dioxide are pumped into tower 10 from a mixer (not shown) through inlet 12, wherein the pulp is bleached and then passes out from pipe 14 into the next stage of the paper forming process.

The chlorine dioxide distributor 18 is provided with a concave or dish-shaped top surface 24 that slopes upwardly from a center port opening. The upwardly sloping sides of the dish-shaped top surface 24 of the distributor 18 influences the floW of the pulp-chlorine dioxide mixture from the center port opening 26, causing it to flow upwardly and outwardly towards the circumference of the upflow tower 10 rather than providing a cascade effect as with a domed-shaped static distributor.

The static distributor 18 is provided with side openings 28 between a plurality of vertical side plates 30 which support the dish-shaped top surface 24 on a base plate 32 provided with an inlet port 34 concentrically located in relation to port opening 26, and a plurality of bores 36 about its circumference for receiving mounting bolts 38 to connect the distributor 18 to opposed flanges 40 and 42 on the tower 10 and inlet pipe 12. The openings 28 are enlarged in that blocking side plates are virtually eliminated.

The vertical support plates 30 supporting the concave or dish-shaped top surface 24 of the distributor 18 have an edge 44 at an angle to the vertical, extending partially into the flow path between concentric ports 26, 34; port 34 having a larger diameter than port 26, and changes the direction of a substantial portion of the incoming flow so that a good portion of the flow is directed radially from port 34 which, when mixed with the upwardly and outwardly influenced flow emanating from port 26 provided by the dish-shaped center portion 24 of the distributor 18, causes more complete mixing of the flow in the bleaching tower 10 as indicated by vortex flow V.

In addition to the improved flow and mixing realized as a result of the design of the distributor of the invention, there is simultaneously realized by virtue of the design an important savings in energy and/or power required.

What is claimed is:

1. A static distributor for use in distributing a flow of pulp and chlorine dioxide into a wood pulp bleaching tower having walls comprising:

a body having a central opening terminating in a concave upper surface in the bleach tower and structured and arranged for directing the flow entering through said opening towards the walls of said bleach tower;

said body having:

a base having an inlet port positioned in spaced, concentric relation to the central opening in said upper surface; and a series of spaced support plates between said base and upper surface spaced about the circumference of said upper surface and supporting said upper surface on said base structured and arranged for directing flow radially through spaced openings formed between said support plates to mix with said flow directed towards the walls of said bleach tower by said upper surface in said tower.

2. The static distributor in accordance with claim 1 wherein each of said support plates include an edge at an angle to the vertical overlying the inlet port in said base.

3. The static distributor in accordance with claim 2 wherein said base includes a plurality of bores about its periphery for mounting said distributor on a support.

* * * * *